US008215855B2

(12) United States Patent
Jacobsen et al.

(10) Patent No.: US 8,215,855 B2
(45) Date of Patent: Jul. 10, 2012

(54) METHOD AND DEVICE FOR THE ALIGNMENT OF SHEET-SHAPED SUBSTRATES

(75) Inventors: Thomas Jacobsen, Kiel (DE); Juergen Sahlmann, Ellerdorf (DE); Bernhard A. Linke, Felde (DE); Rolf Spilz, Gettorf (DE); Christoph J. Ochmann, Kiel (DE); Joerg V. Malottki, Westensee/Brux (DE)

(73) Assignee: Eastman Kodak Company, Rochester, NY (US)

( * ) Notice: Subject to any disclaimer, the term of this patent is extended or adjusted under 35 U.S.C. 154(b) by 591 days.

(21) Appl. No.: 12/441,728

(22) PCT Filed: Sep. 17, 2007

(86) PCT No.: PCT/EP2007/008056
§ 371 (c)(1),
(2), (4) Date: Mar. 18, 2009

(87) PCT Pub. No.: WO2008/034567
PCT Pub. Date: Mar. 27, 2008

(65) Prior Publication Data

US 2009/0311022 A1 Dec. 17, 2009

(30) Foreign Application Priority Data

Sep. 20, 2006 (DE) ..... 10 2006 044 825
Aug. 24, 2007 (DE) ..... 10 2007 040 131

(51) Int. Cl.

| | |
|---|---|
| ***B65H 1/00*** | (2006.01) |
| ***B65H 31/00*** | (2006.01) |
| ***B65H 9/00*** | (2006.01) |
| ***B65H 9/16*** | (2006.01) |
| ***B65H 29/00*** | (2006.01) |
| ***G03G 15/00*** | (2006.01) |
| ***B41J 15/00*** | (2006.01) |

(52) U.S. Cl. ..... 400/579; 400/619; 399/406; 271/8.1; 271/207; 271/226; 271/234; 271/236; 271/248; 271/250; 271/273; 271/314; 414/791.2

(58) Field of Classification Search ..... 400/579, 400/619; 399/406; 271/8.1, 226–230, 234, 271/248–250, 252, 273–274, 207, 236, 314; 414/791.2
See application file for complete search history.

(56) References Cited

U.S. PATENT DOCUMENTS 5,078,384 A * 1/1992 Moore ..... 271/228
5,094,442 A * 3/1992 Kamprath et al. ..... 271/227
(Continued)

FOREIGN PATENT DOCUMENTS

DE 10023940 11/2001
(Continued)

*Primary Examiner* — Michael G Lee
*Assistant Examiner* — Laura Gudorf
(74) *Attorney, Agent, or Firm* — Donna P. Suchy; Christopher J. White

(57) ABSTRACT

Provided is a device for the alignment of sheets in a printing machine, said device comprising two pairs of rollers for the alignment of the sheets in their advance direction, for the alignment transverse to their advance direction and with respect to skewing, whereby each pair of rollers consists of a driving roller and of a counter-pressure roller. One drive unit is provided for each of the two driving rollers, whereby each of the drive units consists of a motor and a drive shaft linked therewith, whereby the driving rollers are non-torsionally accommodated on respective drive shafts. The driving rollers can be slid in linear direction on their drive shaft, or the respective drive shafts, and thus the driving rollers accommodated thereon, can be linearly shifted with respect to their drive motors.

13 Claims, 10 Drawing Sheets

U.S. PATENT DOCUMENTS

| | | | | |
|---|---|---|---|---|
| 5,322,273 | A | 6/1994 | Rapkin et al. | |
| 6,598,870 | B2 * | 7/2003 | Hanano | 271/138 |
| 6,676,123 | B2 * | 1/2004 | Sahlmann | 271/227 |
| 2004/0046313 | A1 * | 3/2004 | Herrmann et al. | 271/226 |
| 2005/0082747 | A1 * | 4/2005 | Tamura et al. | 271/184 |
| 2006/0214364 | A1 | 9/2006 | Clark et al. | |

FOREIGN PATENT DOCUMENTS

| | | |
|---|---|---|
| EP | 1279632 | 12/2004 |
| JP | 1-34836 | 2/1989 |

* cited by examiner

METHOD AND DEVICE FOR THE ALIGNMENT OF SHEET-SHAPED SUBSTRATES

FIELD OF THE INVENTION

The present invention relates to a method and a device for the alignment of sheet-shaped substrates in a printing machine, in particular in an electrophotographically operating printing machine.

BACKGROUND OF THE INVENTION

In printing technology and, in particular in digital multicolor printing technology, it is known to exactly align sheet-shaped substrates, before they are being printed, with respect to their position in advance direction and their position transverse to advance direction, and to align them in view of potential skewing. A device and a method for the alignment of sheet-shaped substrates are known, for example, from document U.S. Pat. No. 6,663,103 B2. The device described therein comprises several pairs of rollers on various axles that are parallel to each other and at a distance from each other in the advance direction of the sheets, said pairs of rollers performing different alignment operations. In this device and method, the technical problem arises that, because the axles of the pairs of rollers that are parallel to each other and at a distance from each other in advance direction of the sheets, the devices takes up a large amount of space. Furthermore, when a transfer takes place between the pairs of rollers that are at a distance from each other in advance direction, an alignment error—that had already been corrected previously—may be introduced.

In addition, a method and a device for the alignment of sheet-shaped substrates in a printing machine is known from document DE 691 24 755 T2. In the device described therein, two pairs of transport rollers, which are spaced apart in a direction transverse to the advance direction of the sheet, are provided. Each of the pairs of transport rollers comprises one driving roller and one counter-pressure roller, both being arranged on a common carriage. The drive motors for the driving rollers are also located on the common carriage. In order to achieve a correction of the skew of a sheet, the driving rollers may be actuated, for example, at different rotational speeds and/or at different points in time. In order to achieve a correction of a sheet position transverse to its advance direction, the aforementioned carriage, which supports the pairs of transport rollers as well as the drive motors for the driving rollers, can be shifted in transverse direction. To achieve this, the carriage is located on a carriage guide so as to be transversely shiftable, and a motor is provided which controls the shift of the carriage along the guide. The motor must be designed in a relatively strong manner because it needs to move the entire carriage, including the drive motors for the driving rollers. In addition, the entire assemblage of the carriage must be designed in highly robust manner in order to prevent that vibrations occurring as a result of the shifting of the carriage will impair the sheet alignment and/or the integrity of the carriage.

SUMMARY OF THE INVENTION

Considering known prior art, the object of the invention is to provide a method and a device for the alignment of sheet-shaped substrates in a printing machine, which avoids one or more disadvantages of the aforementioned literature references.

This object is achieved with a device for the alignment of sheets in a printing machine comprising two pairs of rollers for the alignment of the sheets in their advance direction, for the alignment transverse to their advance direction and with respect to skewing, whereby each pair of rollers consists of a driving roller and a counter-pressure roller that is supported in a freely rotatable manner, whereby respectively one drive unit is provided for each of the two driving rollers, whereby each of the drive units consists of a motor and a drive shaft linked therewith, whereby the driving roller is non-torsionally accommodated on a its drive shaft, and whereby a shifting unit comprising a drive motor for sliding the driving rollers along their drive shaft is provided, said shifting unit being fitted in such a manner that it moves both driving rollers in a synchronized manner along their drive shaft. By shifting the driving rollers on their drive shafts, it is possible to substantially reduce the design size of the motor for a shift in the direction transverse to the advance direction than is the case in the aforementioned DE 69 124 755 T2. Moreover, with such a shift of the driving rollers along their drive shaft, substantially smaller forces come into action, so that fewer vibrations are to be expected in the device, thus allowing a design of the device that may be less rugged in view of vibrations than is the case in the aforementioned device. Preferably, at least one connector is provided which rigidly links the driving rollers in longitudinal direction of the drive shafts in order to provide a synchronous shift of the driving rollers along their drive shaft. Consequently, it is achieved that a distance between the driving rollers remains the same during a transverse shift of the sheet. Advantageously, a bearing is interposed between the connector and respectively one of the driving rollers in order to permit a relative rotation between the connector and the driving roller. Specifically, the drive motor of the shifting unit is linked with the connector in order to provide the transverse shift via the connector which, as a rule, is located between the two driving rollers.

In a preferred embodiment in accordance with the invention, the running surfaces of the driving rollers and/or of the counter-pressure rollers have a cam contour extending transverse to the advance direction. By means of such a cam contour, it can be achieved that a clamping point between the driving roller and the counter-pressure roller remains in essentially the same position, independent of the position of the axes of rotation of the driving rollers and the counter-pressure rollers. This is important, because a proper sheet skew correction requires that the exact distance between each of the clamping surfaces be known and that, even during a shift of the driving rollers relative to the counter-pressure rollers or even during a joint shift, the distance must not change. Preferably, the cam contour defines a circular cam having a center located in a plane that bisects the running surfaces in a direction transverse to the sheet advance direction.

Advantageously, the counter-pressure rollers are supported in a freely rotatable manner on a common axis, as a result of which a simple design is achieved for the arrangement of the counter-pressure rollers. Advantageously, an additional shifting unit for shifting the counter-pressure rollers synchronously with the driving rollers is provided in order to avoid a relative movement between the sheet and the counter-pressure rollers in case of a transverse shift of the sheet. In this case, the additional shifting unit is preferably linked with the common axle in order to shift said axle along its longitudinal direction. By shifting the common axle, it is possible to implement a particularly simple construction of the shifting unit. In order to ensure the synchronism of the driving rollers of the counter-pressure rollers, the additional shifting unit is preferably linked with the drive motor of the shifting unit.

In an alternative embodiment in accordance with the invention, the counter-pressure rollers are stationarily held in the device in longitudinal direction of the drive shafts of the driving rollers. In this embodiment, no shifting unit is required, thus simplifying the overall design of the device. In this case, the counter-pressure rollers preferably have an extension in longitudinal direction of the drive shafts of the driving rollers, said extension corresponding to a maximum shift range of the driving rollers to ensure that an opposing counter-pressure roller is provided over the entire transverse shift of the driving rollers. Advantageously, the coefficient of friction of the running surfaces of the driving rollers is greater, with respect to a sheet to be transported, than that of the counter-pressure rollers, in order to permit a proper transverse shift of the sheets without damaging the surface of said sheet.

In one embodiment in accordance with the invention, a control unit for controlling the shifting of the driving rollers is provided, said control unit being suitable for shifting the driving rollers out of a starting position and returning them into said position after a shifting operation. As a result of this, a specific starting position may be assumed for the specific positioning of the sheet, thus substantially simplifying the control of the device. Preferably, a sensor is provided for the detection of the starting position of the driving rollers in order to ensure that a specific starting position is used as the starting point each time.

Advantageously, the counter-pressure rollers are biased in the direction of the driving rollers in order to ensure a good clamping action between the driving and counter-pressure rollers during an alignment and a positioning of the sheets, even in the case of varying sheet thicknesses. Advantageously, this bias is created via a spring element that is centrally arranged with respect to the common axle that supports the counter-pressure rollers, whereby a particularly simple construction of the device can be achieved.

In order to be able to permit a free feeding of a sheet between the driving and counter-pressure rollers, the driving rollers are preferably configured as segmented rollers, whereby these have at least one segment that is cut out of their circumferences in order to release the sheets. This segmentation also permits a free downstream transport of a sheet between the rollers by means of an external handling device, should this be desired. The cut out segment preferably takes up approximately ⅕ to ⅛ of the circumference of the driving roller. For good guidance of a sheet inside the device, at least two guide baffles are provided which, between them, define a sheet-guiding gap that is located in the same plane as a contact region of the two pairs of rollers.

In one embodiment in accordance with the invention, the device comprises an upper part that supports the driving rollers and a lower part that supports the counter-pressure rollers, whereby the upper part and the lower part can be moved relative to each other in order to permit access to a sheet-moving section in the device. Preferably, at least one guide baffle is supported on the upper part and essentially one guide baffle is supported on the lower part in order to limit the sheet-moving section. Advantageously, the upper part and the lower part can be pivoted relative to each other along a pivot axis, whereby, in a particularly simple manner, access can be provided to the sheet-moving section. Preferably, a drive element for shifting the counter-pressure rollers extends in the region of the pivot axis between the upper and lower parts in order to prevent the drive element from impairing a pivoting between the upper and lower parts. Of course, this is only necessary when the drive element extends between the upper part and the lower part, for example, when the drive element is linked to a motor mounted to the upper part. Alternatively, a separate drive unit for a linear shift of the counter-pressure rollers could be provided on the lower part. In this case, this separate drive unit can preferably be actuated in such a manner that shifting of the driving rollers and counter-pressure rollers is synchronous.

Preferably, the device comprises a plurality of sensors for the detection of a position and for the alignment of a sheet in the device, whereby, for example, skew sensors, cross-track position sensors and transport direction sensors are provided. Advantageously, a control unit is provided which is suitable to control individually the rotation of the driving rollers, as well as their joint shifting along their drive shaft, as a function of a sheet position and/or of a sheet alignment. To do so, the control unit is preferably connected to a plurality of sensors.

The object to be achieved by the invention is also achieved by means of a method for the alignment of a sheet in the device of the aforementioned type in that, a skew of a sheet in the device is initially detected, a rotary motion of the driving rollers is individually controlled as a function of the detected skew in order to perform a skew correction, if necessary. Subsequently, a position of the sheet transverse to its advance direction is detected and a shift of the driving rollers along their drive shafts is controlled so as to move the sheet into a pre-specified position transverse to its advance direction. With the use of an appropriate control of the rotary motion of the driving rollers, as well as their shift on their drive shaft, it is possible to effect a skew alignment as well as a transverse alignment of the sheet.

Advantageously, in order to detect a skewed position of the sheet, the position of the leading edge of the sheet is detected at least at two points that are at a distance from each other transverse to the advance direction. Based on the time difference between the detection of the respective leading edges, with the distance between the detection points and the transport speed of the sheet being known, it is possible to detect the skewed position of a sheet in a simple and accurate manner.

In one embodiment of the invention, the leading edge of the sheet is first detected by two sensors that are upstream of the driving rollers—viewed in advance direction of the sheet—and that are at a distance from each other transverse to the advance direction. Based on the difference in time when the leading edge is detected by the sensors, the driving rollers are controlled so as to grasp the sheet in each case at essentially the same distance from the leading edge. For example, this is achieved in that a rotation of the driving rollers is started at different points in time (corresponding to the time difference in the detection of the leading edge by the sensors). Subsequently, once the sheet has been grasped by the driving rollers, the leading edge of the sheet can be detected again by two sensors that are at a distance from each other in a direction transverse to the advance direction. Considering the advance direction of the sheet, these sensors would be arranged downstream of the driving rollers in order to permit detection of the leading edge after being grasped by the driving rollers. Based on a time difference in the detection of the leading edge, now the speed of rotation of the respective driving rollers can be controlled in order to perform a skew correction of the sheet. However, the driving rollers could also be actuated based on the detection of the leading edge by a single upstream or a downstream pair of sensors—viewed in advance direction.

At least one line sensor is used for the detection of the position of the sheet in a direction transverse to its advance direction, said line sensor permitting an accurate position transverse to the advance direction of the sheet across a broad operating range. Preferably, two sensors are used in order to facilitate the detection of an exact position when different sheet formats are used and in order to achieve, in particular, a centering of the sheet transverse to its advance direction, independent of the transverse dimensions of the sheet.

For a skew correction of the sheets, on the one hand, the rotary motion of the driving rollers is preferably started at different points in time and, on the other hand, the driving rollers are preferably actuated at different speeds of rotation.

For a correction of a potential skewed position of a sheet, it is possible to simultaneously perform a rough or temporary co-correction of a transverse position of the sheet by means of an appropriate transverse shift of the driving rollers. As a result of this simultaneous skew alignment or skew correction by means of an alignment or of a correction of a transverse position, a sheet can be aligned particularly quickly. Even if a subsequent correction regarding the transverse position were to become necessary following the correction of the skewed position, this correction could be performed quicker than if it were completely performed as a correction of the transverse position following a correction of a potential skewed position.

Advantageously, the driving rollers are actuated in such a manner that the cut out segments are in the same position of rotation following a skew correction of the sheet, so that, subsequently, the sheet will be released at the same time with the rotation of the driving rollers being synchronous at that point. Advantageously, the position of the respective sheet is detected in its advance direction, and the rotary motion of the driving rollers is controlled so as to bring the sheet into a pre-specified position in said sheet's advance direction. Such a position alignment in advance direction preferably occurs following a skew alignment and after an alignment with respect to the transverse position by means of a corresponding—then synchronous—actuation of the driving rollers. In this case, the synchronous actuation of the rotary motion of the driving rollers preferably includes a concurrent change of the speed of the rotary motion, which may also include a stop of the rotation followed by a re-start. Preferably, the position alignment in advance direction is, however, achieved in that the rotation of the driving rollers need not be stopped at any time while they are in an engagement with the sheet.

In a particularly preferred embodiment in accordance with the invention, the position of the sheet in advance direction is adapted, for its electrophotographic printing, to the leading edge of an already running electrophotographic imaging of electrophotographic printing form, this also being referred to as the paper-follows-image process. As a result of this, the electrophotographic imaging of an electrophotographic printing form can be initiated already before an appropriate alignment of the sheet and, subsequently, the sheet can be aligned in advance direction with respect to this imaging. Alternatively, it is possible, of course, to omit a position alignment in advance direction and to adapt an electrophotographic imaging of an electrophotographic printing form to a position detection of the sheet, this also being known as the image-follows-paper process.

The object of the invention is also achieved by a printing machine comprising a device of the aforementioned type, in which case the device is arranged upstream of at least one printing unit of the printing machine.

Preferably, such a printing machine is an electrophotographic printing machine and the device can be controlled in such a manner that it adapts the position of a sheet for its electrophotographic printing to the position of an already running electrophotographic imaging of an electrophotographic printing form of the printing machine.

Hereinafter, the invention will be explained in detail with reference to exemplary embodiments of the invention and with reference to drawings.

DETAILED DESCRIPTION OF THE INVENTION

Figure 1:
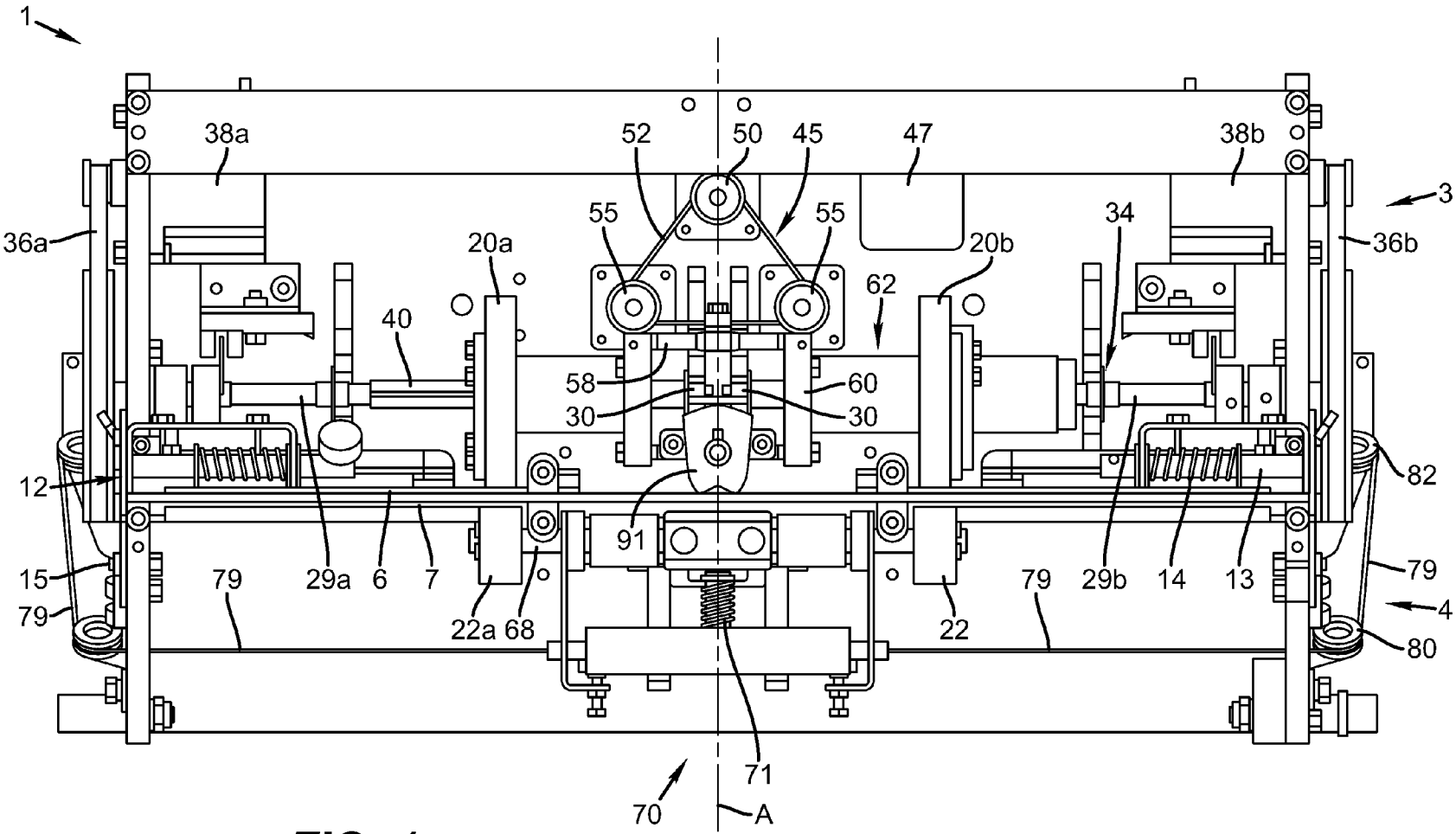
FIG. 1 a rear view of a device in accordance with the invention for the alignment of sheets.

FIG. 1 is a rear view of a device 1 for the alignment of sheets in a printing machine, in particular in an electrophotographically operating printing machine. As a rule, such a device 1 is located in the path of movement of the sheets through the printing machine upstream of an appropriate printing unit or a plurality of printing units in order to provide proper alignment and positioning of a sheet for a subsequent printing of said sheet.

Figure 2:
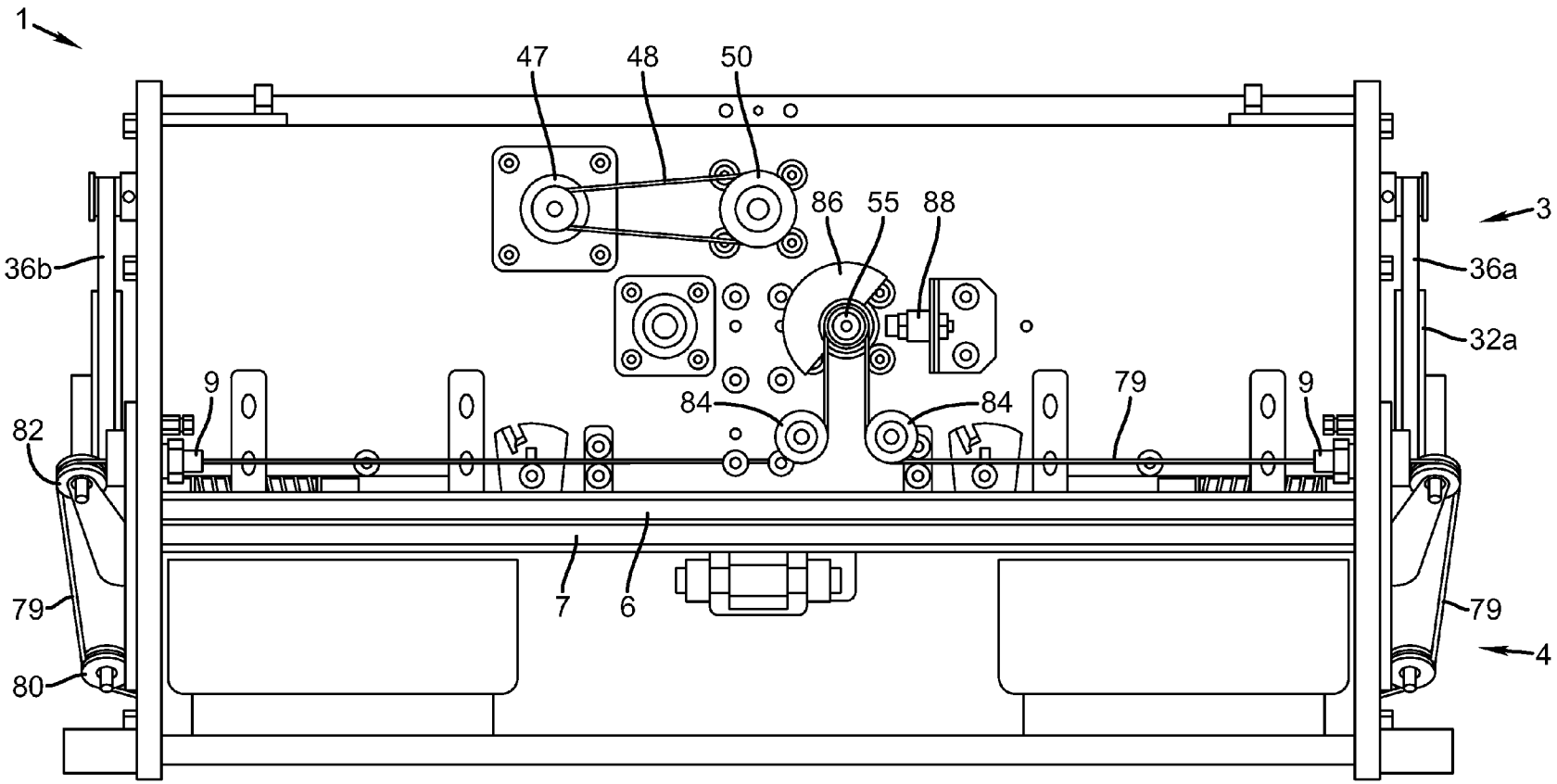
FIG. 2 a front view of the device in accordance with FIG. 1.
Figure 3:
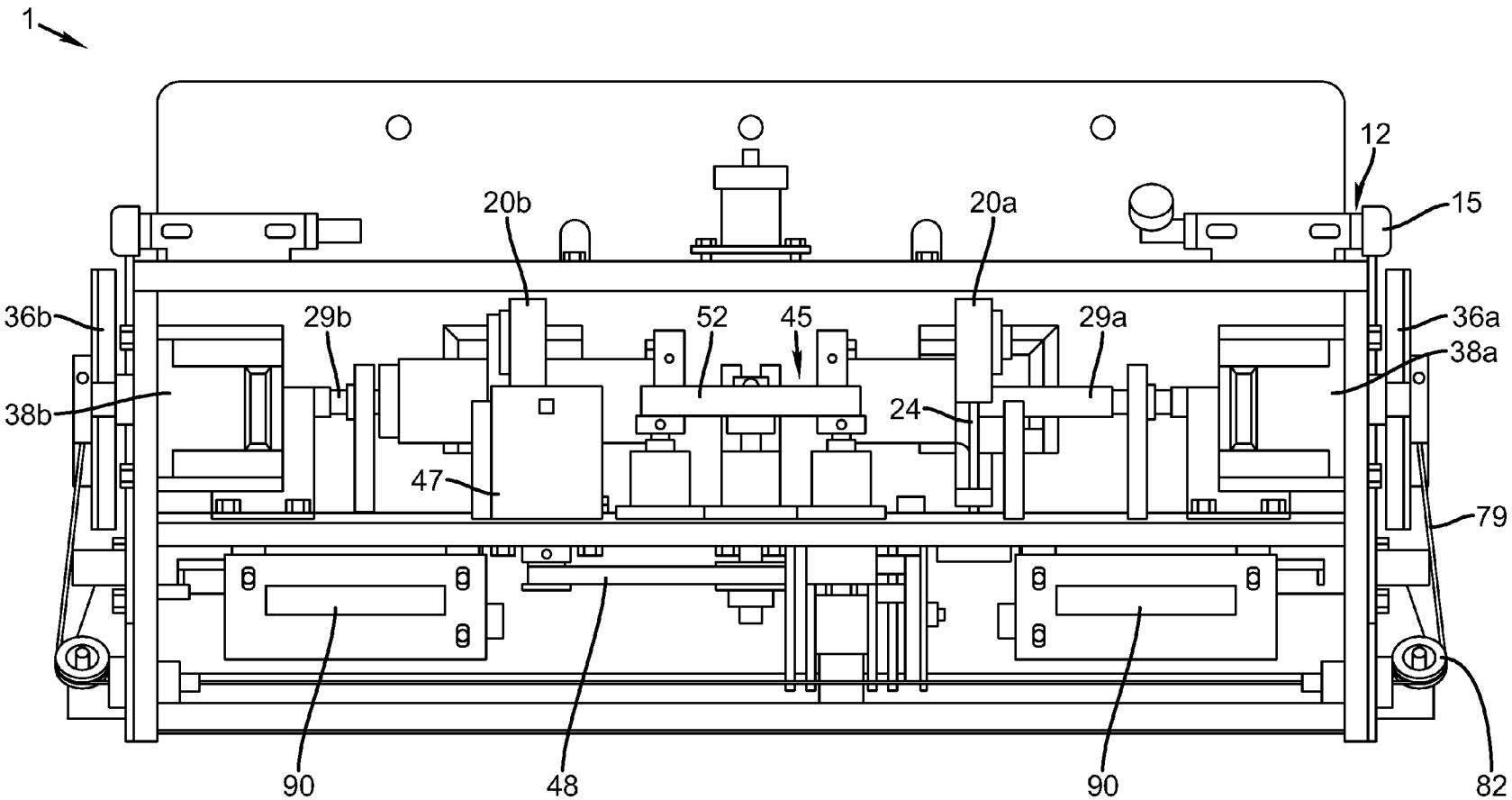
FIG. 3 a plan view of the device in accordance with FIG. 1.
Figure 4:
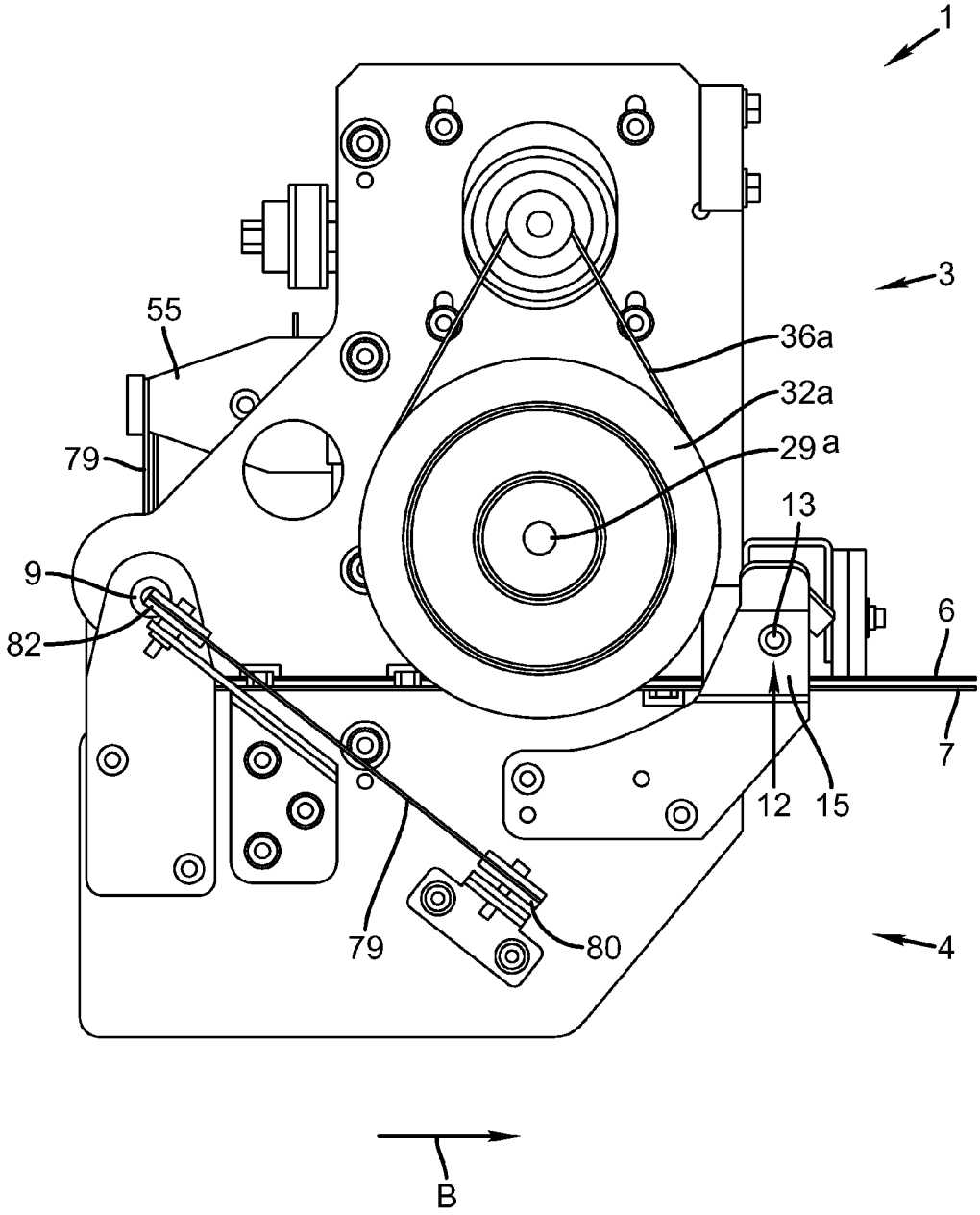
FIG. 4 a side view of the device in accordance with FIG. 1.

FIGS. 2, 3 and 4, respectively, show a front view, a plan view or side view of the device 1. In the description hereinafter, information regarding directions, such as, for example, left, right, front, back, etc., refers to the respective illustration in the drawings, without the intention of having this information restrict the invention.

The device 1 consists of an upper part 3 as well as of a lower part 4, between which a sheet transport plane is being defined. A cross-sectional plane A divides the device into left and right halves that are symmetrical regarding many components. In order to provide upper and/or lower limits of the sheet transport plane, a guide baffle 6 is provided on the upper part 3, and a guide baffle 7 is provided on the lower part 4.

In the region of a pivot axis that is formed by two pivot pins 9, the upper part 3 and the lower part 4 can be pivoted relative to each other in order to permit access to the sheet transport plane. The pivot pins 9 are located on a front end, viewed in transport or advance direction (see the arrow B in FIG. 4) of a sheet through the device 1. In the region of the rear end of the device 1, viewed in advance direction, a locking device 12 is provided in order to lock the upper part 3 and the lower part 4 together in a position that defines the transport plane. The locking device 12 is best seen in the front view in accordance with FIG. 1. The locking device 12 has a locking pin 13 fastened to the upper part 3, said locking pin being biased in locking position by means of a spring 14. In locking position, the pin 13 is in engagement with a locking opening on a tab 15 fastened to a lower part 4.

Figure 5A:
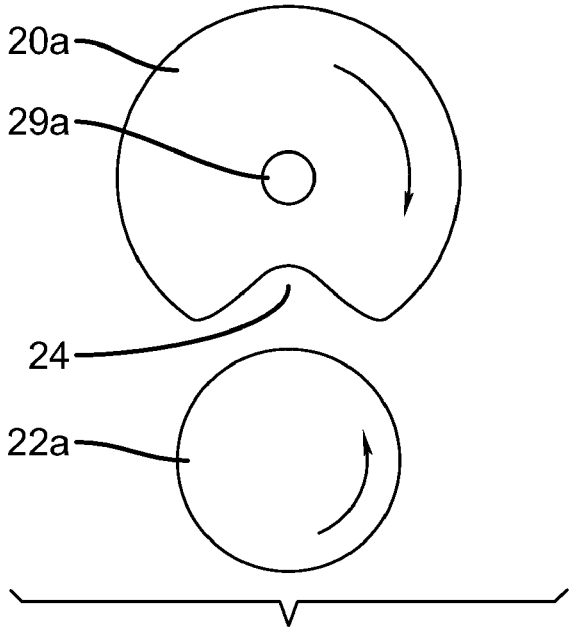
FIGS. 5*a* and 5*b* schematic side views of a pair of transport rollers, in different positions of rotation.
Figure 5B:
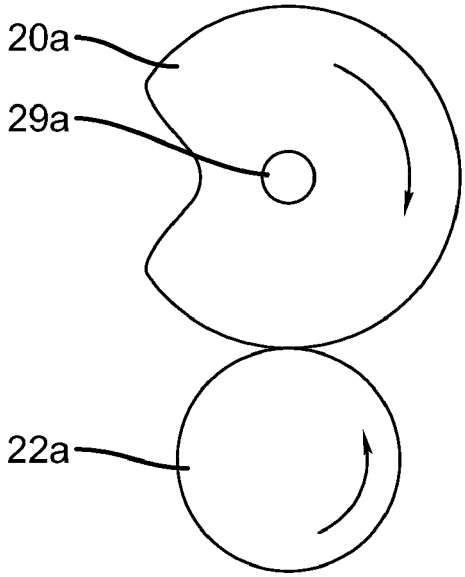

The upper part 3 supports two driving rollers 20*a*,20*b* which form two pairs of transport rollers—as will be explained in detail hereinafter—with corresponding counter-pressure rollers 22*a*,22*b* on the lower part 4. A schematic side view of such a pair of transport rollers 20*a*,22*a* is illustrated in two different positions in FIGS. 5*a* and 5*b*.

As it appears on the schematic side views in accordance with FIG. 5, the driving roller has a circular form interrupted by a segment cutout 24. As can also be seen in the plan view of FIG. 3, this segment cutout 24, when facing toward the corresponding counter-pressure roller, is disposed to ensure the unhindered feeding of a sheet between the driving roller 20*a* and the counter-pressure roller 22*a*.

Each of the driving rollers 20*a*,20*b* is accommodated in a non-torsional manner on a corresponding shaft 29*a*,29*b*. In this arrangement, each driving roller 20*a*,20*b* is accommodated on its own shaft 29*a*,29*b*. The respective shafts 29*a*,29*b* are rotatably supported on their inner ends—with respect to the transverse center plane A—by means of an appropriate holding clamp 30. The shafts 29*a*,29*b* are non-torsionally connected with a belt pulley 32*a*,32*b* on their outer ends—with respect to the transverse center plane A of the device 1. Between its outer ends, the shafts 29*a*,29*b* may also be rotatably supported in one or more locations, as is indicated, for example at 34.

Each of the belt pulleys 32*a*,32*b* is linked with the output of a motor 38*a*,38*b* via a belt 36*a*,36*b*. Consequently, each of the driving rollers 20*a*,20*b* can be individually actuated as to its direction of rotation via a corresponding motor 38*a*,38*b*.

Together, the respectively connected shafts 29*a*,29*b*, the belt pulleys 32*a*,32*b*, the belts 36*a*,36*b* and the motors 38*a*, 38*b* form together respectively a rotary drive for one of the driving rollers 20*a*,20*b*, whereby two separate drivetrains, i.e., one for each driving roller 20*a*,20*b*, are provided.

In their receiving section for the driving rollers, each of the shafts 20*a*,20*b* has contours, which permit a non-torsional connection between the shafts 29*a*,29*b* and the drive shafts 20*a*,20*b*. However, the contours have a form that does not impair a linear shift of the driving rollers on the respective shaft 29*a*,29*b*. Each of the driving rollers 20*a*,20*b* is connected with a bearing cage 39 or designed in one piece therewith. Contained in the bearing cages 39 are not specifically illustrated bearings in order to permit a good linear shift of the respective driving rollers 20*a*,20*b* on the respective shaft 29*a*,29*b*.

In order to permit an appropriate linear shift of the driving rollers 20*a*,20*b* on their shafts 29*a*,29*b*, a linear shifting unit 45 is provided. The linear shifting unit 45 comprises a motor 47 that is connected to a deflecting roller 50 via a belt 48 (FIG. 2). The deflecting roller 50, in turn, is connected with two additional deflecting rollers 55 via a belt 52. In this arrangement, the deflecting rollers 50, 55 are arranged in such a manner that the belt, when tensioned around them, has an essentially triangular form (with rounded corner regions). Between the deflecting rollers 55, the belt 52 is linked with a connecting clamp 58. The connecting clamp 58, in turn, is linked with the driving rollers 20*a*,20*b* via corresponding connectors 60 and the bearing cages 39. The connection between the connecting clamp 58 and the driving rollers 20*a*,20*b* is such that they are freely rotatable relative to the connecting clamp 58, however, are rigidly linked therewith, i.e., not in a shiftable manner, along their axis of rotation. Consequently, the driving rollers 20*a*,20*b* are rigidly connected via the connecting clamp 58, but they can be rotated freely relative to each other.

Consequently, the linear shifting unit 45 is disposed to be able to shift the driving rollers 20*a*,20*b* in linear direction and in a synchronous manner on their shafts 29*a*,29*b*, as will be explained in detail hereinafter.

As previously described, the counter-pressure rollers 22*a*, 22*b*, which, together with the driving rollers 20*a*,20*b*, form a pair of transport rollers, are provided on the lower part 4 of the device 1. Each of the counter-pressure rollers 22*a*,22*b* is supported so as to be freely rotatable on a common axle 68. The axle 68 is biased—in the direction of the upper part 3—in the center between the two counter-pressure rollers 22*a*,22*b* via a biasing unit 70 that, for example, comprises a spring 71. As a result of this, the counter-pressure rollers 22*a*,22*b* are biased relative to their driving rollers 20*a*,20*b*. A not specifically illustrated abutment limits the movement of the counter-pressure rollers 22*a*,22*b* in the direction of the driving rollers. Alternatively, it is possible, of course, to separately bias the counter-pressure rollers via their own biasing units in the direction of the upper part.

The counter-pressure rollers 22*a*,22*b* can be laterally shifted via a linear shifting unit, i.e., corresponding to the linear shift of the driving rollers 20*a*,20*b*. The linear shifting unit 72 comprises a cable pull 79 which is rigidly connected with the biasing unit 70 and the axle 68 supporting the counter-pressure rollers 22*a*,22*b*. In order to permit a controlled linear shift, the biasing unit 70 and/or the axle 68 are guided in the lower part 4 of the device 1 in a not specifically illustrated manner.

The cable pull 79 extends over the deflecting rollers 80 on the lower part 4 and the deflecting rollers 82 on the upper part 3 between the upper and lower parts of the device 1. The deflecting rollers 82 area arranged on the upper part in such a manner that the cable pull 79 extends through the pivot pins 9. As a result of this, it can be ensured that the cable pull 79 extending between the lower and upper parts does not impair the pivoting of the two parts with respect to each other. In the region of the lower part 4, the cable pull 79 extends in transverse direction over the lower part 4 and is linked with the biasing unit 70 and the axle 68 in this region. In the region of the upper part 3, the cable pull 79 extends essentially along the pivot axis between the upper and lower parts, again transversely with respect to the device 1. In an intermediate region, the cable pull 79 is deflected via appropriate deflecting rollers 84 and guided in a driven manner in this region around one of the deflecting rollers 55. Via the latter, the cable pull 79 is thus linked with the motor 47. Therefore, a rotary motion of the motor 47 causes a corresponding movement of the cable pull 79 and, via the latter, a corresponding movement of the counter-pressure rollers 22*a*,22*b*. In this arrangement, the linear shifting units 45, 72 are configured in such a manner that the driving rollers 20*a*,20*b* and the counter-pressure rollers 22*a*,22*b* are shifted synchronously. Alternatively, it would also be possible to provide a separate motor for a linear shift of the counter-pressure rollers, said motor being mounted, for example, to the lower part. In this case, the cable pull 79 could be omitted and, in particular, it would not be necessary to provide such an element extending between the upper and the lower parts.

In the region, in which the cable pull 79 is guided around a deflecting roller 55, said deflecting roller 55 has a tab 86, the position of which is sensed by an appropriate sensor 88. Based on the detected position of the tab 86, it is possible—as is obvious to the person skilled in the art—to determine a shifting position of the deflecting rollers 55 and thus a corresponding shifting position of the driving 20*a*,20*b* and counter-pressure rollers 22*a*,22*b* in the device 1. Of course, it is also possible to provide other means for carrying out a position determination for the driving rollers and/or the counter-pressure rollers.

In the region of the sheet transport plane, the device 1 has a first—not illustrated—pair of sensors consisting of two sensors, in particular, edge sensors, which are at a distance from each other transverse to the advance direction of a sheet. The first pair of sensors—viewed in advance direction of a sheet through the device 1—is arranged upstream of the respective pairs of transport rollers, each pair consisting of a driving roller 20*a*,20*b* and of a counter-pressure roller 22*a*, 22*b*. As a result of this, a detection of a leading edge of the sheet becomes possible before said sheet enters between the rollers of the pair of transport rollers. Furthermore, a second—not illustrated—pair of sensors, in particular, edge sensors, consisting of two sensors arranged at a distance from each other transverse to the advance direction of a sheet are provided in the region of the sheet transport plane. The second pair of sensors is arranged, in advance direction of a sheet through the device 1, downstream of the respective pairs of transport rollers, each pair consisting of a driving roller 20*a*, 20*b* and of a counter-pressure roller 22*a*,22*b*. As a result of the detection of a leading edge of a sheet at different times at the respective sensors of a pair of sensors, a skew error of the sheet can be detected, as has been known in the art. Each of the sensors is linked with a not illustrated control device. Although the first pair of sensors was described as being located in the region of the sheet transport plane of the device 1, it should be noted that a corresponding pair of sensors may also be provided in an upstream device.

Furthermore, the device 1 comprises lateral edge sensors which, for example, are configured as line sensors 90 (FIG. 3). Such lateral edge sensors are capable of detecting the actual position of the lateral edges of a sheet and thus the lateral position (i.e., transverse to advance direction) of a sheet. These lateral edge sensors are arranged upstream of the pairs of transport rollers, viewed in advance direction (arrow B in FIG. 4) of a sheet moving through the device 1. Alternatively, they may also be arranged downstream of the pairs of transport rollers, viewed in advance direction. In addition, a leading edge sensor 91 (FIG. 1) located preferably in the center in a direction transverse to the advance direction of a sheet in the device 1 is provided. This sensor is located downstream of the pairs of transport rollers, viewed in advance direction of the sheet through the device 1. This leading edge sensor permits the detection of a position of a sheet in said sheet's advance direction.

The sensors are connected to a control unit which, by using the sensor data, is capable of actuating the motors 38 and/or the motor 47 in order to enable a rotation of the driving rollers 20*a*,20*b* and, optionally, a linear shift of the driving rollers 20*a*,20*b* and of the counter-pressure rollers 22*a*,22*b*.

The operation of the above-described device will be explained in detail hereinafter. First, a sheet to be printed is fed from the left (as in FIG. 4) between the guide baffles 6, 7. At this time, the driving rollers 20*a*,20*b* are positioned in such a manner that the segment cutout 24 faces the counter-pressure rollers 22*a*,22*b*, so that the sheet can be transported freely between the driving and the counter-pressure rollers 20*a*,20*b*, 22*a*,22*b*. Before the sheet is fed between the driving and the counter-pressure rollers 20*a*,20*b*, 22*a*,22*b*, the leading edge is detected by the first pair of sensors at two points that are a distance from each other in a direction transverse to the advance direction. If the detection occurs at the same time, the sheet is correctly aligned from the viewpoint of skewing and, thereafter, the driving rollers 20*a*,20*b* can be actuated synchronously via their corresponding drivetrains in order to transport the sheet in between them and in order to transport said sheet through the device 1.

However, if a skewed position should exist, which is detected by the chronologically different detection of the leading edge of the sheet at the spaced-apart sensors, then the driving rollers 20*a*,20*b* will be differently actuated. In particular, the start of rotation of the respective driving rollers will initially be controlled—by using the chronologically different detection of the leading edge of the sheet by the first pair of sensors—in such a manner that the driving rollers 20*a*,20*b* grasp the sheet at substantially the same distance from the leading edge of the sheet.

Subsequently, the leading edge of the sheet is detected by the second pair of sensors at two points that are at a distance from each other in a direction transverse to the advance direction. Now the skew of the sheet is determined on the basis of the detection of the leading edge of the sheet at different times by the second pair of sensors, a known distance between the sensors, and a known advance speed of the sheet. Based on the determined skew, the driving rollers 20*a*,20*b* are now actuated at different speeds in order to correct the skewed position of the sheet in a known manner by way of said driving rollers.

Following an appropriate correction of the skewed position of the sheet, the lateral edges of the sheet are detected by the corresponding line sensors 90. If the lateral edge detection indicates that the sheet is properly positioned in a direction transverse to the advance direction of the sheet through the device 1, no shifting of the driving and counter-pressure rollers 20*a*,20*b*, 22*a*,22*b* in a direction transverse to the device 1 occurs. If, however, a corresponding detection at the lateral edge sensors 90 indicates that the sheet is not properly positioned in transverse direction, the control unit actuates the motor 47 accordingly in order to provide a transverse shift of the driving rollers 20*a*,20*b* as well as of the counter-pressure rollers 22*a*,22*b* until a corresponding proper transverse positioning of the sheet has occurred. Instead of a sequential correction of the skew and the transverse position, it is also possible to perform—at least partially at the same time—a correction of these two parameters. For example, it is possible—already before and/or during a skew correction—to perform a lateral edge detection that is to be used for the correction of the transverse position.

Finally, the leading edge of the sheet is detected again. On the basis of this detection and by the appropriate actuation of the rotary motion of the driving rollers 20*a*,20*b*, the movement of the sheet in advance directing is controlled in such a manner that said sheet is transferred to a downstream device for a continuous transport at a pre-specified time. Consequently, the sheet is finally positioned—as a function of time—in its advance direction. This positioning takes place via a corresponding control of the speed profile of the rotary motion of the driving rollers. In so doing, the rotary motion may also be stopped in the extreme situation, whereby, however, preferably a stopping of the rotary motion is to be avoided. At the time of transfer to the downstream device, the driving rollers 20*a*,20*b* are preferably positioned in such a manner that the segment cutouts 24 face the counter-pressure rollers in order to permit a continued transport that is hindered to the least-possible degree. The sheet is then transported at a pre-specified speed by the downstream device out of the device 1 in order to feed said sheet to a subsequent printing operation. In so doing, the transport of the sheet out of the device 1 can be adapted to an already running electrophotographic imaging of an electrophotographic printing form—this also being known as a paper-follows-image process—for example, by means of a corresponding control of the time of transfer. In so doing, the sheet movement is adapted to an already completed imaging in an electrophotographic printing process. Alternatively, however it is also possible to omit a control of the transfer time by a position control in advance direction of the sheet when the printing process is adapted to a position of the sheet—this also being known as an image-follows-paper process.

Finally, the driving rollers 20*a*,20*b* are moved back into the starting position, in which the segment sections 24 face the counter-pressure rollers 22*a*,22*b* and in which the driving rollers and the counter-pressure rollers 20*a*,20*b*, 22*a*,22*b* are in a pre-specified position in transverse direction of the device 1. In this case, the pre-specified position is selected in such a manner that the driving rollers 20*a*,20*b* and the counter-pressure rollers 22*a*,22*b* are arranged symmetrically with respect to the transverse center plane A of the device 1.

Referring to FIGS. 6 through 11, an alternative embodiment of a device 1 for the alignment of sheets in a printing machine will be described hereinafter. In the description of the exemplary embodiment in accordance with FIGS. 6 through 9, the same reference numbers are used if the same or similar elements are provided.

Again, the device 1 has an upper part 3 and a lower part 4, between which a sheet transport plane is defined. Again, a guide baffle 6 is provided on the upper part 3, and a guide baffle 7 is provided on the lower part 4.

Again, the upper and lower parts 3, 4 can be pivoted relative to each other in the region of a pivot axis formed by appropriate pivot bearings 9. Likewise, a locking device 12 of the same type and manner is provided in order to interlock the upper part and the lower part with each other.

Again, the upper part 3 supports two driving rollers 20*a*, 20*b* which, with the appropriate counter-pressure rollers 22*a*, 22*b* on the lower part 4, form two pairs of transport rollers.

Figure 6:
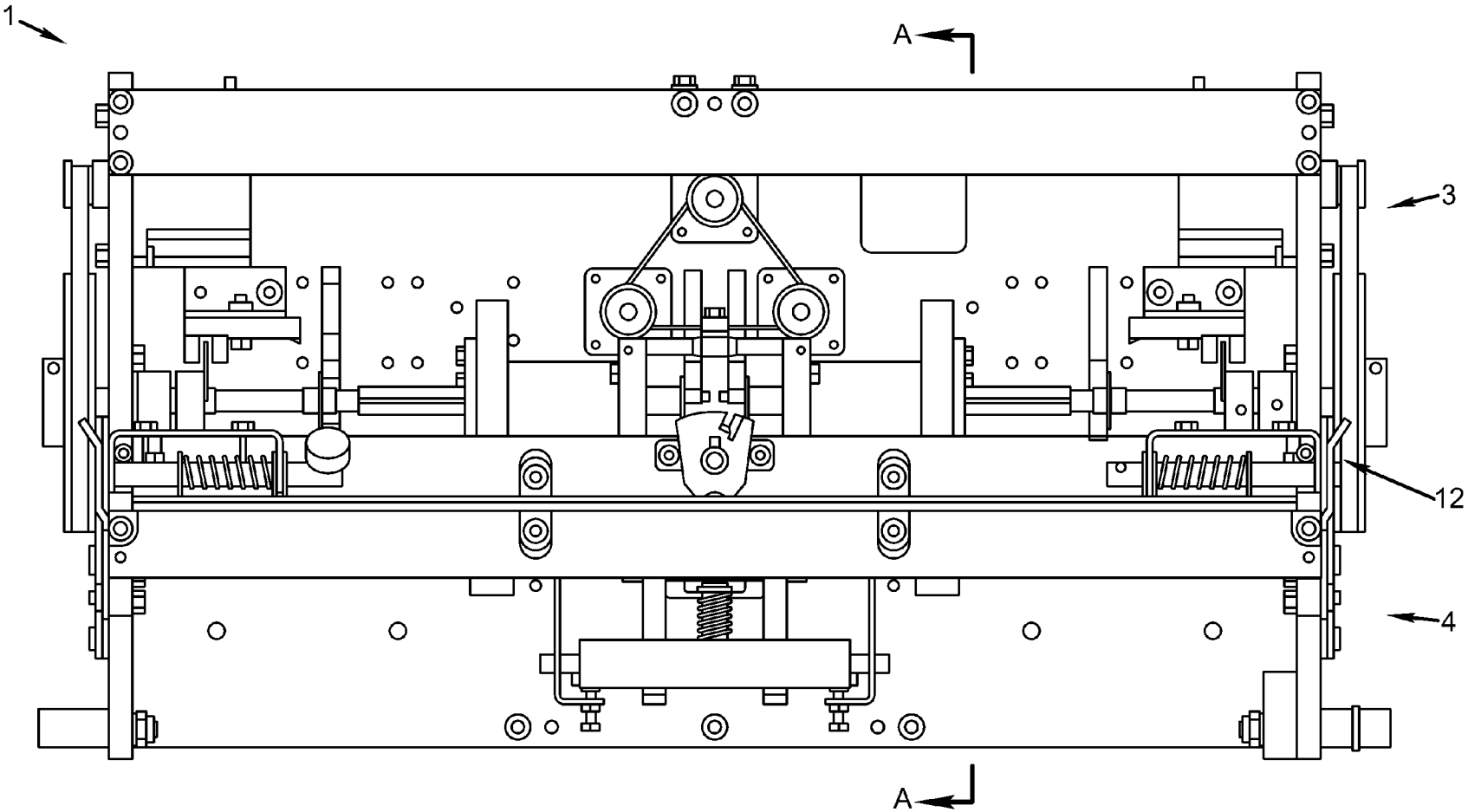
FIG. 6 a rear view of an alternative device for the alignment of sheets in accordance with the invention.
Figure 7:
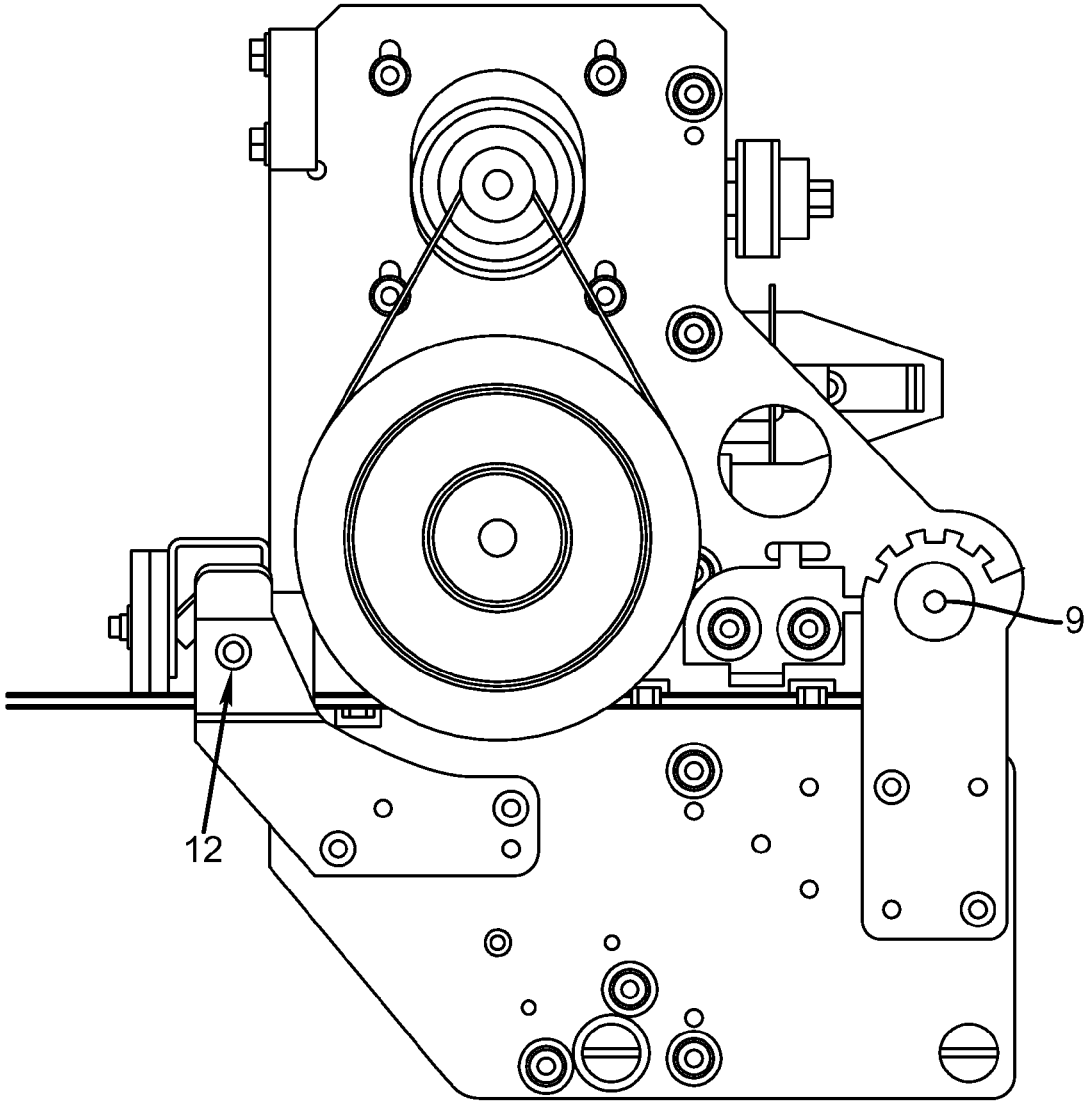
FIG. 7 a side view of the device in accordance with FIG. 5.
Figure 8:
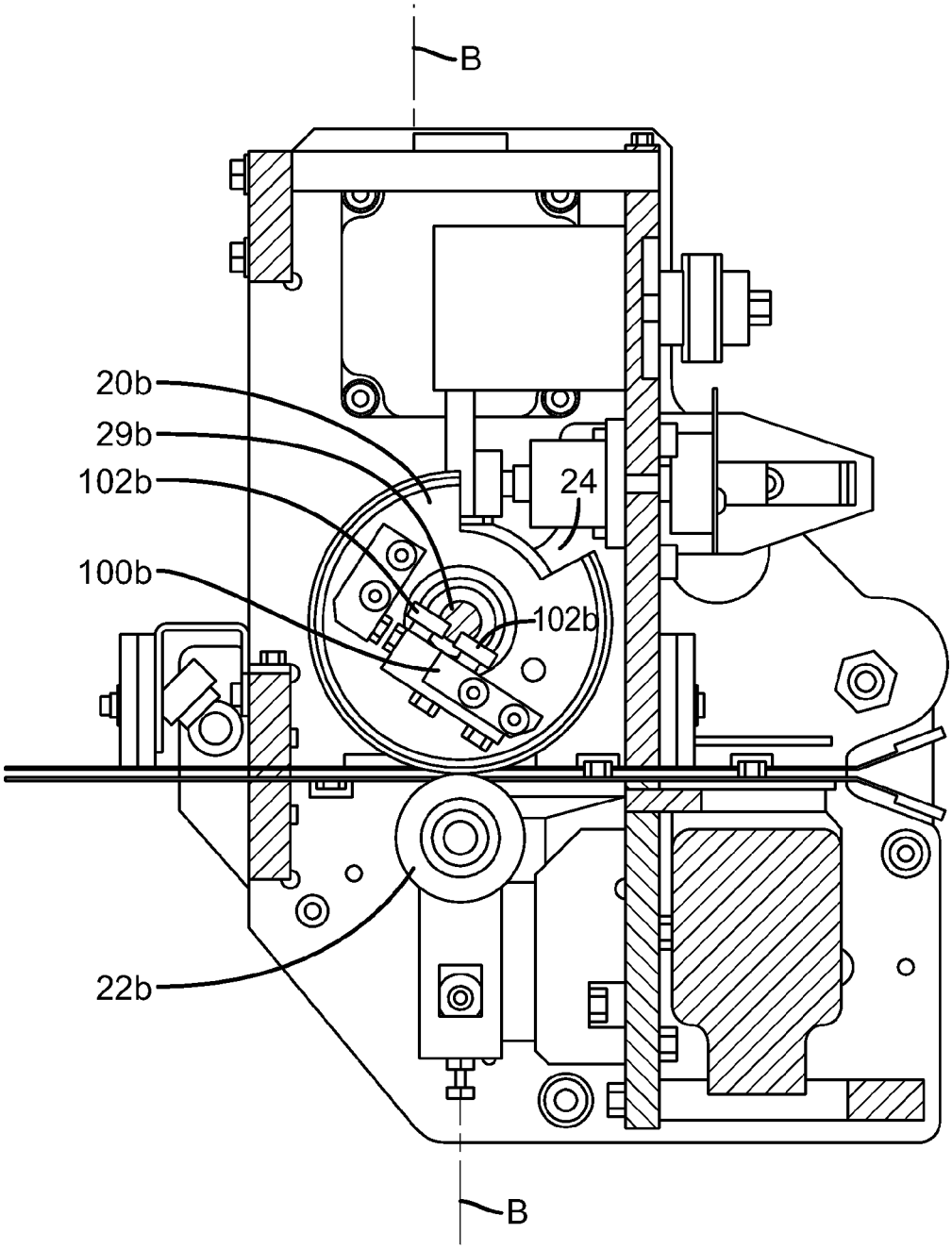
FIG. 8 a sectional view along the line A-A in FIG. 5.

FIG. 8, which depicts a sectional view along line A-A in FIG. 6, is a schematic side view of a pair of transport rollers comprising for example the driving roller 20*b* and the counter-pressure roller 22*b*. As is obvious from the depiction in accordance with FIG. 8, the driving roller 20*b* again has a segment cutout 24.

The driving rollers 20*a*,20*b* are accommodated non-torsionally on a corresponding shaft 29, whereby, again, each driving roller 20*a*,20*b* is accommodated on its own shaft 29*a*,29*b*. FIG. 8 shows that the shaft 29*b* has two cutouts on its circumference in order to form a dog 100 extending in longitudinal direction of the shaft 29*b*. Bearings 102*b* area provided on both sides of said dog, said bearings being rigidly connected with the driving roller 20*b* via appropriate fastening clamps. Consequently, an engagement of the dog 100*b* with the bearings 102*b* transfers a rotary motion of the shaft 29*b* to the driving roller 20*b*. However, the bearings 102*b* permit a longitudinal movement of the driving roller 20*b* along the shaft 29*b*. Of course, other configurations are also possible in order to provide a non-torsional but linearly shiftable connection between the driving roller 20*b* and the shaft 29*b*.

Figure 9:
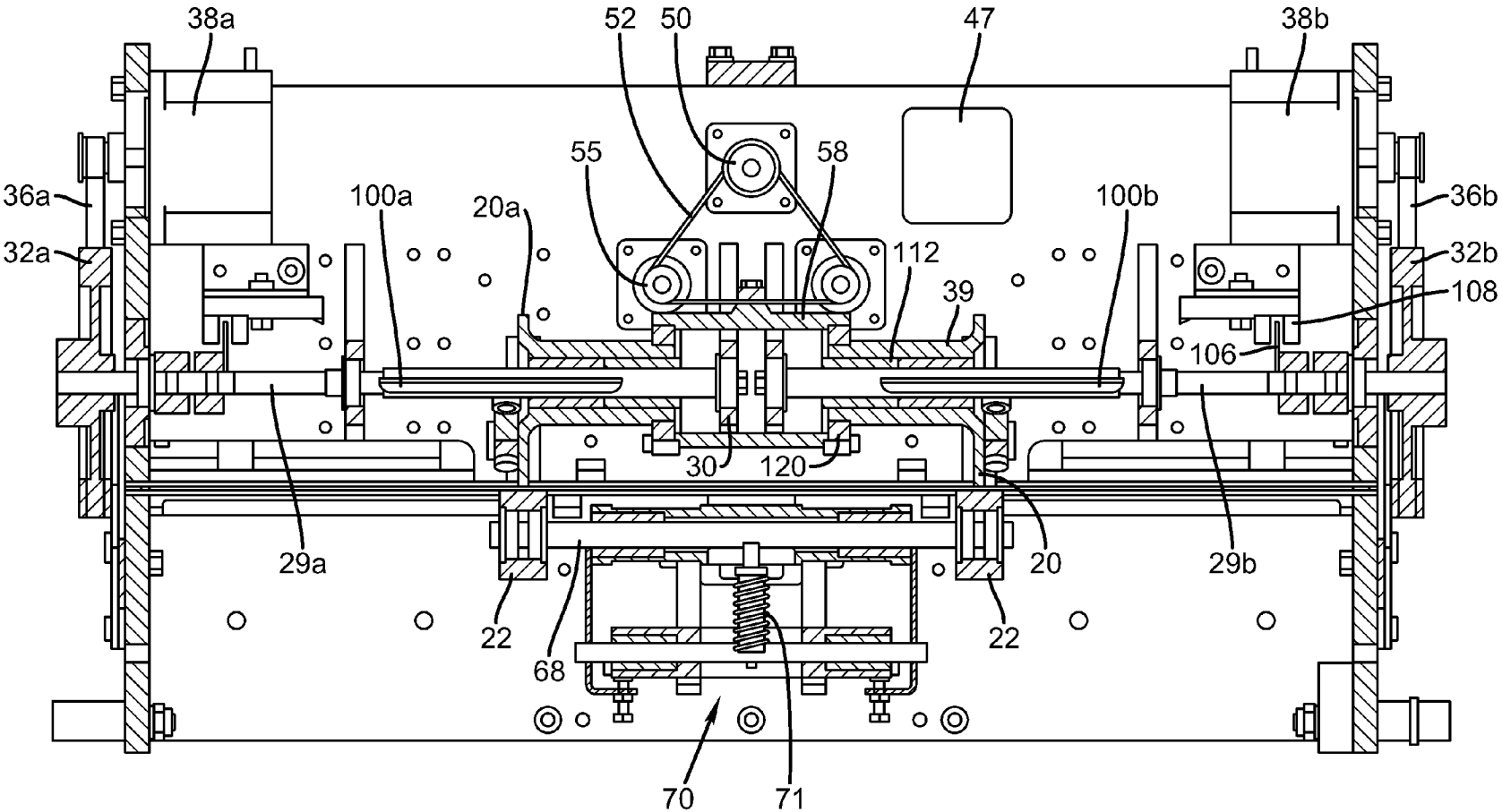
FIG. 9 a sectional view along the line B-B in FIG. 7.

Again, the respective shafts 29*a*,29*b* are rotatably supported on their inner ends—viewed with respect to a transverse center plane A—via an appropriate holding clamp 30 that is best seen in the sectional view in accordance with FIG. 9. Additional support locations may be provided along the longitudinal extension of the shaft 29*a*,29*b*. Again, the outer ends of the shafts are connected with one belt pulley 32*a*,32*b*, respectively.

Furthermore, each of the shafts 29*a*,29*b* is provided with a tab 106 that can be detected by an appropriate sensor 108 in order to be able to determine a rotary position of the shaft 29*a*,29*b* and thus of the driving rollers 20*a*,20*b*.

Via an appropriate belt 36*a*,36*b*, each of the belt pulleys 32*a*,32*b* is connected with the output of a corresponding motor 38*a*,38*b*. Consequently, as in the previous exemplary embodiment, each of the driving rollers 20*a*,20*b* can be actuated regarding its direction of rotation via a corresponding motor 38*a*,38*b*.

As is best recognized in the sectional view in accordance with FIG. 9, each of the driving rollers comprises one bearing cage 39, which accommodates linear bearings 112 that perform a linear shift of the driving rollers 20*a*,20*b* on the shafts 29*a*,29*b*. In an alternative embodiment of the invention, a non-torsional connection between the driving rollers 20*a*,20*b* and the shafts 29*a*,29*b* could also be achieved via linear bearings 112 that perform a catch function. In this case, the above-described bearings 102*a*,102*b* could be omitted.

In order to enable a corresponding linear shift of the driving rollers 20*a*,20*b* on their shafts 29*a*,29*b*, again, a linear shifting unit 45 having the same design as the linear shifting unit 45 of the first exemplary embodiment is provided. In particular, the linear shifting unit 45 comprises a motor 47, which is connected with a deflecting roller 50 via an appropriate belt. This deflecting roller 50, in turn, is connected to two additional deflecting rollers 55 via a belt 52. In this arrangement, the deflecting rollers 50, 55, as is best seen in FIGS. 6 and 9, are again arranged in such a manner that the belt tensioned around the deflecting rollers describes essentially a triangular form. Between the deflecting rollers 55, the belt is firmly connected with a connecting clamp 58. The connecting clamp 58 is again connected with the corresponding bearing cages 39 of the driving rollers 20*a*,20*b*. The connection between the connecting clamp 58 and the bearing cages 39 is selected in such a manner that the bearing cages 39 can be rotated relative to the connecting clamp 58 but are rigidly linked therewith in a transverse shifting direction. This is achieved, for example, via appropriate bearings 120 between the connecting clamp 58 and the bearing cage 39 of the driving rollers 20*a*,20*b*. Consequently, the driving rollers 20*a*,20*b* can be shifted in linear direction on their shafts 29*a*,29*b* by means of linear shifting units 45.

As in the case of the previous exemplary embodiment, the counter-pressure rollers 22*a*,22*b*, which form a pair of transport rollers together with the driving rollers 20*a*,20*b*, are provided on the lower part 4 of the device 1. The counter-pressure rollers 22*a*,22*b* are again supported in a freely rotatable manner on a common axle 68. The axle 68 is again biased in the direction of the upper part 3, namely between the two counter-pressure rollers 22*a*,22*b*, via a biasing unit 70, which comprises a spring 71, for example. In contrast with the previous exemplary embodiment, however, the counter-pressure rollers 22*a*,22*b* are stationarily held on the lower part 4 in the embodiment in accordance with FIGS. 6 through 11, i.e., they cannot be linearly shifted together with the driving rollers 20*a*,20*b*. Instead, the counter-pressure rollers 22*a*,22*b* have sufficient width in order to be located opposite one driving roller each time a linear shift of the driving rollers occurs. In addition, the coefficient of friction of the surface of the counter-pressure rollers is lower, with respect to the sheet to be aligned, than that of the running surface of the driving rollers 20*a*,20*b*. Consequently, during a linear shift of the driving rollers 20*a*,20*b*, a sheet located between the driving roller 20*a*,20*b* and the counter-pressure roller 22*a*,22*b* is shifted together with the driving rollers 20*a*,20*b* and relative to the counter-pressure rollers 22*a*,22*b*.

Consequently, the device in accordance with FIGS. 6 through 11 has a substantially simpler configuration because a shifting of the counter-pressure rollers 22*a*,22*b* is not provided.

Figure 10A:
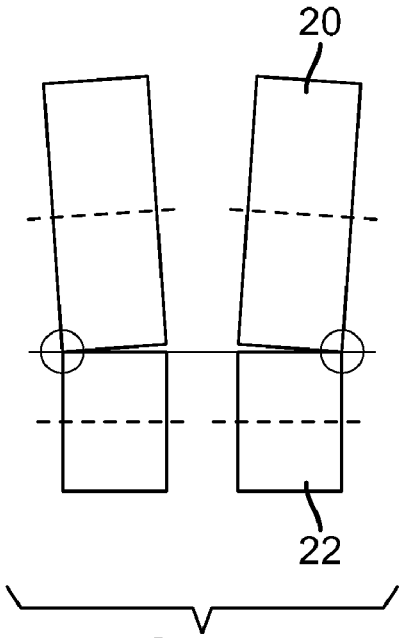
FIGS. 10*a* and 10*b* different examples of axial misalignments between the pairs of transport rollers of a device for the alignment of sheets.
Figure 10B:
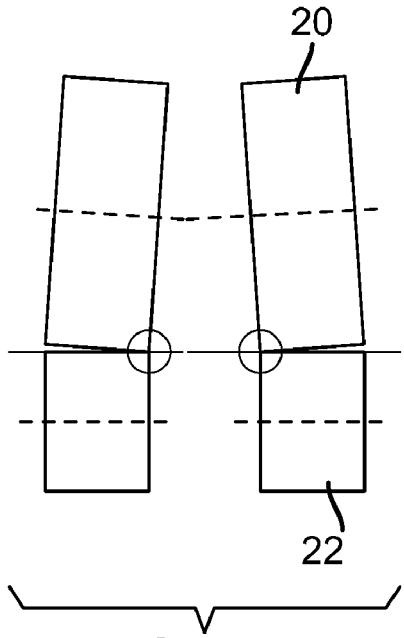

As is further obvious from FIG. 9 and, in even greater detail from FIG. 11, the running surface of the driving rollers 20 has a ball-shaped configuration, i.e., it has a curved form in a direction transverse to running direction, in particular a circular curved form having a center located on a plane bisecting the running surface in transverse direction. The reason for such a ball-shaped configuration of the running surfaces of the driving rollers 20 will be explained in detail hereinafter with reference to FIGS. 10 and 11. FIG. 10 shows two schematic front views of pairs of moving roller pairs with running surfaces configured as circular cylinders on the upper driving rollers 20 as well as on the lower counter-pressure rollers 22. If the respective axes of rotation of the driving rollers 20 and of the counter-pressure rollers 22 are not in exact parallel alignment, the clamping points between the driving roller 20 and the counter-pressure roller 22 may be different across the width of the respective rollers. In case of an axle misalignment in accordance with FIG. 10*a*, the clamping points migrate outward, so that their total distance reaches a maximum. In case of an axle misalignment in accordance with FIG. 10*b*, the clamping points migrate inward, so that their distance reaches a minimum. Inasmuch as, however, a proper skew correction requires that the distance between the clamping points be known for an appropriate actuation of the driving rollers 20, the variability of the clamping points and their distances can result in alignment problems.

Figure 11A:
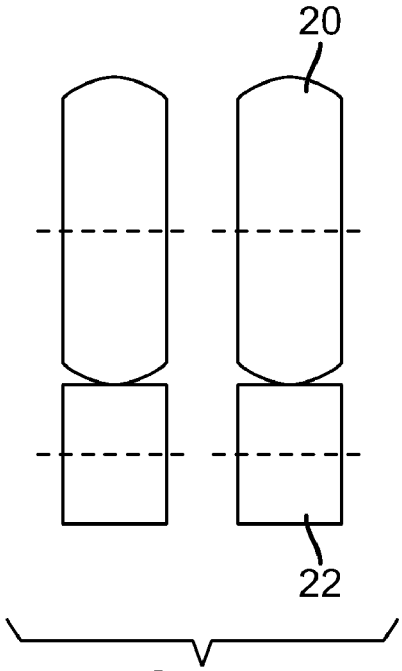
FIG. 11*a* schematic view of a pair of rollers in accordance with the present invention; and, FIG. 11*b* an axial misalignment of a pair of rollers in accordance with FIG. 10*a*.
Figure 11B:
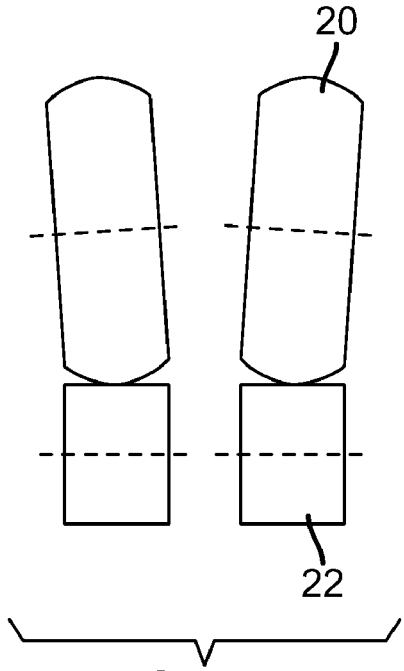

FIG. 11*a* shows a pair of transport rollers consisting of a driving roller 20 with a ball-shaped running surface and a counter-pressure roller 22 with a running surface configured as a circular cylinder. It should be noted here that the counter-pressure rollers 22 according to FIG. 11 are substantially larger than the driving rollers 20, in order to allow a shift of the driving rollers whilst the counter-pressure rollers remain in position on the axis direction. FIG. 11*a* shows one position of the clamping points between the two rollers in axis-parallel state, and FIG. 11*b* shows one position of the clamping points in the case of a deviation from the axis-parallel state. As is clearly recognizable, the ball-shaped configuration of the running surfaces of the driving rollers 20 can prevent—even in the case of an axial misalignment of the driving rollers 20—a substantial change of the position of the clamping point between the driving roller 20 and the counter-pressure roller 22. Consequently, high accuracy can be achieved during an alignment.

In respect to the position and number of sensors, the embodiment in accordance with FIGS. 6 through 11 resembles that of the previously described embodiment.

Likewise, the operation of the device 1 in accordance with FIGS. 6 through 11 resembles the previously described operation with the exception that no transverse shift of the counter-pressure rollers 22*a*,22*b* occurs. Rather, in case of a corresponding transverse shift of the driving rollers, a sheet is moved transversely with the use of the driving rollers, this being possible because the coefficient of friction between the running surface of the driving rollers and the sheet is greater than it is between the sheet and the running surface of the counter-pressure rollers 22*a*,22*b*. This can be achieved by an appropriate selection of materials for the corresponding running surfaces.

In the above embodiments, the driving rollers 20*a*,20*b* are non-torsionally, and in a linearly shiftable manner, arranged on their shafts 29*a*,29*b*. In an alternative embodiment of the invention, however, it would also be possible to arrange the driving rollers so as to be non-torsional and not shiftable in a linear manner on their shafts 29*a*,29*b*. In this case, the shafts 29*a*,29*b* could be arranged so as to be shiftable in a linear manner in the upper part 3 of the device. Furthermore, the shafts 29*a*,29*b* could be arranged so as to be accommodated in a linearly shiftable manner in the respective belt pulleys 32*a*,32*b*, while they continue to be connected therewith in a non-torsional manner. The remaining design of the device 1 could be maintained unchanged. As a result of this, the design of the driving rollers 29*a*,29*b* could be substantially simplified. In particular, the bearing cages 39, which could be provided on the belt pulleys in an equivalent manner, could be omitted. As a result of this, the total weight of the elements that are to be transversely shifted for a transverse alignment could be reduced even further, if necessary. A weight reduction would result if the shafts 29*a*,29*b* had a lower weight than the bearing cages 39 and the linear bearings 112 accommodated therein, these having previously been shifted as a unit with the driving rollers 20*a*,20*b*.

Previously, the invention was explained in detail with reference to preferred embodiments, without being restricted to specifically illustrated embodiments. Individual features of different embodiments may be interchanged freely and or combined, provided compatibility exists.

The invention claimed is:

1. A device for the alignment of sheets in a printing machine, the device comprising:

two pairs of rollers for the alignment of sheets in a direction transverse to an advance direction and with respect to a skewed position, whereby each pair of rollers consists of a driving roller having a driving roller running surface and of a counter-pressure roller having a counter pressure roller running surface that is supported in a freely rotatable manner;

two drive units, one drive unit for each of the two driving rollers, each of the drive units including a respective motor and a respective drive shaft linked therewith, the driving rollers being non-torsionally accommodated on the respective drive shafts and shiftable in a linear direction on the respective drive shafts;

one or more driving roller and counter pressure roller running surfaces having a cam contour extending transverse to the advance direction; and a shifting unit including a drive motor for sliding the driving rollers along the respective drive shafts, the shifting unit adapted to move the two driving rollers in a synchronized manner along the respective drive shafts;

wherein the cam contour defines a circular cam having a center located in a plane that bisects the one or more running surfaces in a transverse direction.

2. The device according to claim 1 further comprising at least one connector which rigidly links the driving rollers in a longitudinal direction relative to the drive shafts wherein at least one bearing is interposed between the connector and one of the driving rollers in order to permit a relative rotation between the connector and the driving roller.

3. The device according to claim 1, wherein the counter-pressure rollers are stationarily held in the device in a longitudinal direction of the drive shafts relative to the driving rollers and the counter-pressure rollers extend in the longitudinal direction of the drive shafts of the driving rollers, the extension corresponding to a maximum shift range of the driving rollers, wherein a coefficient of friction of the driving roller running surfaces is greater, with respect to a sheet to be transported, than that of the counter-pressure rollers.

4. The device in according to claim 1, wherein the driving rollers are segmented rollers, having at least one segment that is cut out of a driving roller circumference in order to release the sheet.

5. The device according to claim 1 wherein the device comprises an upper part that supports the driving rollers and a lower part that supports the counter-pressure rollers, whereby the upper part and the lower part can be moved relative to each other in order to permit access to a sheet-moving section in the device.

6. A method for aligning a sheet in a device, the method comprising:

detecting skew of the sheet in the device, the device including:

two pairs of rollers, each pair including a respective drive roller and a respective counter-pressure roller , for the alignment of sheets in a direction transverse to the advance direction and with respect to a skewed position, and two drive units, and a respective drive unit for each of the two driving rollers, wherein the driving rollers are non-torsionally accommodated on a drive shaft and shiftable in a linear direction thereon;

individually controlling a rotary motion of the driving rollers as a function of the detected skew to perform a skew correction;

detecting a position of the sheet in a cross-track direction transverse to an advance direction of the sheet; and, shifting the driving rollers in a synchronized manner along the respective drive shafts in the cross-track direction to bring the sheet into a pre-specified position in the cross-track direction.

7. The method according to claim 6, further including detecting the position of the leading edge of the sheet at least at two points that are at a distance from each other in the cross-track direction in order to detect a skewed position.

8. The method according to claim 7, the detecting step further including detecting a skew in advance direction of the sheet upstream of the driving rollers, and controlling the start of a rotary motion or the speed of the driving rollers on the basis of the detection.

9. The method according to claim 7, the detecting step further including detecting a skew in advance direction of the sheet downstream of the driving rollers, and controlling the start of a rotary motion or the speed of the driving rollers on the basis of this detection.

10. The method according to claim 6, further comprising detecting a position of the sheet in the cross-track direction using at least one line sensor.

11. The method according to claim 6, the detecting step of the skew further including, at the same time the skew correction of the sheet is performed, performing a rough or temporary co-correction of a transverse position of the sheet by means of an appropriate transverse shift of the driving rollers.

12. The method according to claim 6, further comprising providing an upper part that supports the counter-pressure rollers and a lower part that supports the driving rollers wherein the upper part and the lower part can be moved relative to each other in order to permit access to a sheet-moving section in the device and an actuator communicates with the drive rollers to actuate the driving rollers so that the cut out segments are in the same position of rotation following a skew correction of the sheet.

13. The method according to claim 6, wherein the position of the sheet is detected in an advance direction, and a rotary motion of the driving rollers is controlled to bring the sheet into a pre-specified position in the sheet's advance direction.

* * * * *